US006903625B2

(12) United States Patent
Esker

(10) Patent No.: US 6,903,625 B2
(45) Date of Patent: Jun. 7, 2005

(54) MICROSTRIP RF SIGNAL COMBINER

(75) Inventor: Paul M. Esker, Ellicott City, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 43 days.

(21) Appl. No.: 10/685,444

(22) Filed: Oct. 16, 2003

(65) Prior Publication Data

US 2005/0083149 A1 Apr. 21, 2005

(51) Int. Cl.[7] ..... H01P 5/12

(52) U.S. Cl. ..... 333/116; 333/128; 333/248; 333/239

(58) Field of Search ..... 333/116, 128, 333/238, 246

(56) References Cited

U.S. PATENT DOCUMENTS 4,394,630 A * 7/1983 Kenyon et al. ..... 333/116
4,823,097 A * 4/1989 Konishi et al. ..... 333/116
4,967,171 A * 10/1990 Ban et al. ..... 333/116
5,006,821 A 4/1991 Tam
5,032,803 A * 7/1991 Koch ..... 333/116
5,363,071 A * 11/1994 Schwent et al. ..... 333/111
5,486,798 A * 1/1996 Veitschegger ..... 333/116
5,539,362 A * 7/1996 Culling ..... 333/116
6,590,472 B2 * 7/2003 Borodulin et al. ..... 333/116
6,822,532 B2 * 11/2004 Kane et al. ..... 333/116

FOREIGN PATENT DOCUMENTS

EP 0 291 694 A1 11/1988
EP 0 671 776 A1 9/1995

* cited by examiner

*Primary Examiner*—Benny Lee
*Assistant Examiner*—Kimberly E Glenn
(74) *Attorney, Agent, or Firm*—Birch, Stewart, Kolasch & Birch, LLP

(57) ABSTRACT

A microwave signal combiner having a dielectric board with a main line on one surface and a plurality of cascaded input lines on a second, and opposite surface. The second surface includes a ground plane while the first surface is devoid of any ground plane. The combiner may be mounted at right angles to another circuit board with the provision of L-shaped mounting brackets secured at first and second ends of the dielectric board.

5 Claims, 3 Drawing Sheets

MICROSTRIP RF SIGNAL COMBINER

BACKGROUND OF THE INVENTION

1. Field of the Invention

The invention in general relates to microwave power circuits, and more particularly to a device for combining the outputs of a plurality of high power amplifiers and combining them into a unitary signal.

2. Description of Related Art

In various RF circuits it is often necessary to amplify certain RF signals. However, a single amplifier may not be suitable due to space/weight constraints on a circuit board or due to power limitations of the amplifier. Accordingly, it is common to divide the signal into a plurality of identical signals and provide them to a like plurality of amplifiers. The outputs of these amplifiers are then combined to achieve the desired power rating which is greater than a single amplifier.

An RF combiner is a passive RF device used to add together, in equal proportions, two or more of these RF signals. One common type of combiner is the Wilkinson combiner which is easily added to a circuit board but however, takes up too much space on the board. Another type of combiner is the serial stripline coupler. This combiner is smaller than the Wilkinson combiner and utilizes a plurality of layers of dielectric with interposed striplines and ground planes. This structure results in a combiner which is complicated to manufacture and which exhibits undesired losses. The present invention obviates the drawbacks of current combiner circuits.

SUMMARY OF THE INVENTION

A microwave signal combiner in accordance with the present invention includes a dielectric board having first and second surfaces with a microstrip main line disposed on the first surface. A plurality of cascaded microstrip coupled lines is disposed on the second surface, each for receiving a microwave signal for coupling to the microstrip main line. A ground plane is positioned on the second surface straddling the microstrip coupled lines, while the first surface is devoid of any ground plane. The microstrip main line is substantially coextensive with the microstrip coupled lines.

Further scope of applicability of the present invention will become apparent from the detailed description provided hereinafter. It should be understood, however, that the detailed description and specific example, while disclosing the preferred embodiment of the invention, is provided by way of illustration only, since various changes and modifications within the spirit and scope of the invention will become apparent to those skilled in the art, from the detailed description.

BRIEF DESCRIPTION OF THE DRAWINGS

The present invention will become more fully understood from the detailed description provided hereinafter and the accompanying drawings, which are not necessarily to scale, and are given by way of illustration only, and wherein.

DESCRIPTION OF THE PREFERRED EMBODIMENT

Figure 1:
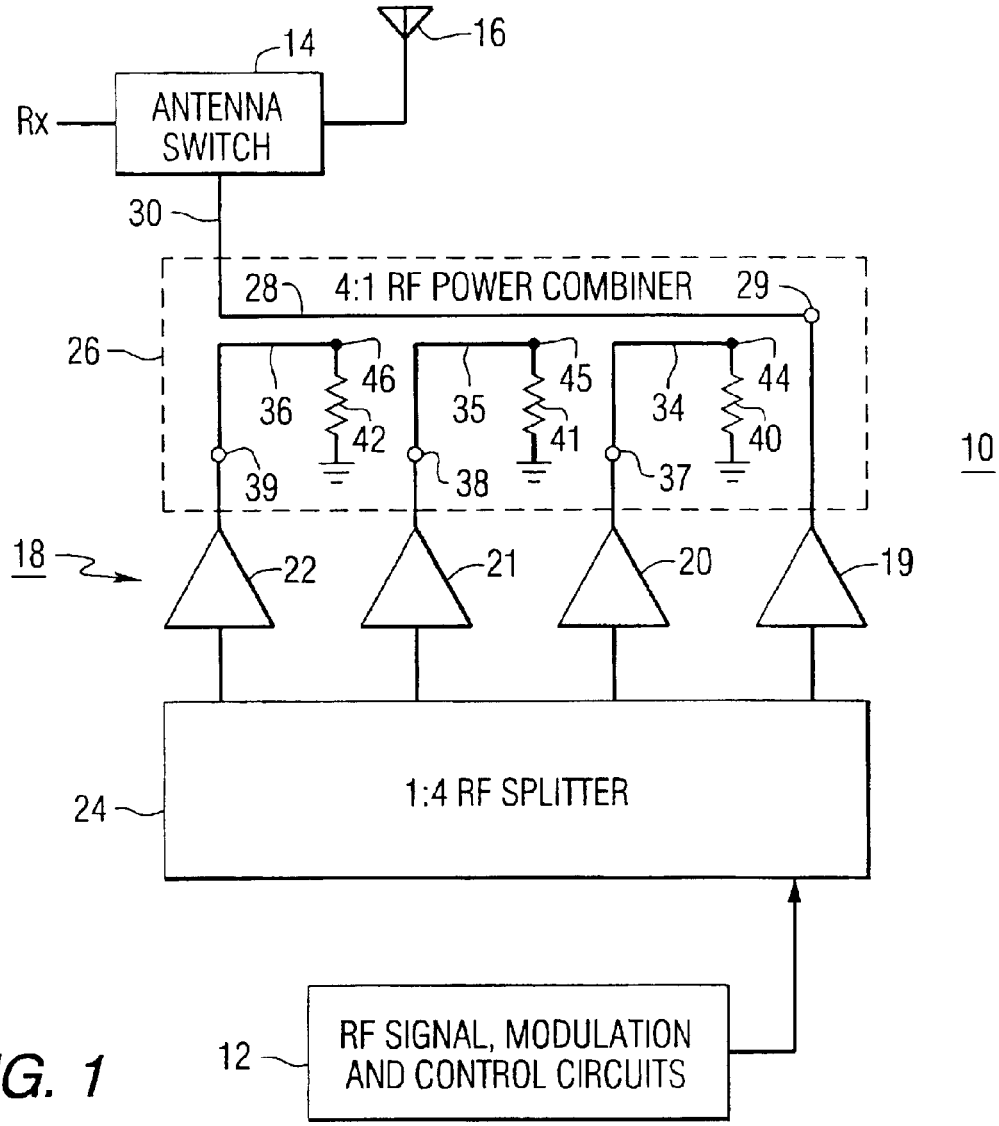
FIG. 1 represents a circuit in which the present invention may be used.

FIG. 1 is a simplified representation of a transmitter 10 which includes transmitter circuitry 12 such as RF signal generation, modulation and control circuitry. Output signals to be transmitted are provided through antenna switch 14 to an antenna 16, via a high power amplification stage 18.

The high power amplification stage may be constituted by a single high power amplifier, however a single amplifier with the desired power rating may be either too massive for mounting on a circuit board, or may not be available with that power rating. Accordingly, and as illustrated in FIG. 1, a plurality of high power amplifiers, each of a lesser rating, but totaling up to the desired rating, may be used. Thus in FIG. 1, the high power amplifier stage 18 includes a plurality of high power amplifiers, for example four, 19, 20, 21 and 22.

Prior to amplification, the signal from transmitter circuitry 12 is dived into four equal paths by 1:4 RF signal splitter 24 for presentation to respective high power amplifiers 19 to 22. After amplification, the four outputs from the high power amplifiers are combined for delivery to antenna 16, in 4:1 signal combiner 26. The present invention will be described with respect to this signal combiner, although its structure may be used as a signal splitter, with a reversal of the illustrated input and outputs.

The 4:1 signal combiner 26 includes a microstrip main line 28 having one end connected to an input 29, for receiving the output of high power amplifier 19, and a second end connected to output 30. The 4:1 combiner 26 additionally includes three microstrip coupled lines 34, 35 and 36 having respective inputs 37,38 and 39, for receiving the respective outputs of high power amplifiers 20, 21 and 22. The other ends of these coupled lines 34, 35 and 36 are connected to respective grounded resistors 40, 41 and 42, by means of connections 44, 45 and 46, for isolation purposes.

Figure 2:
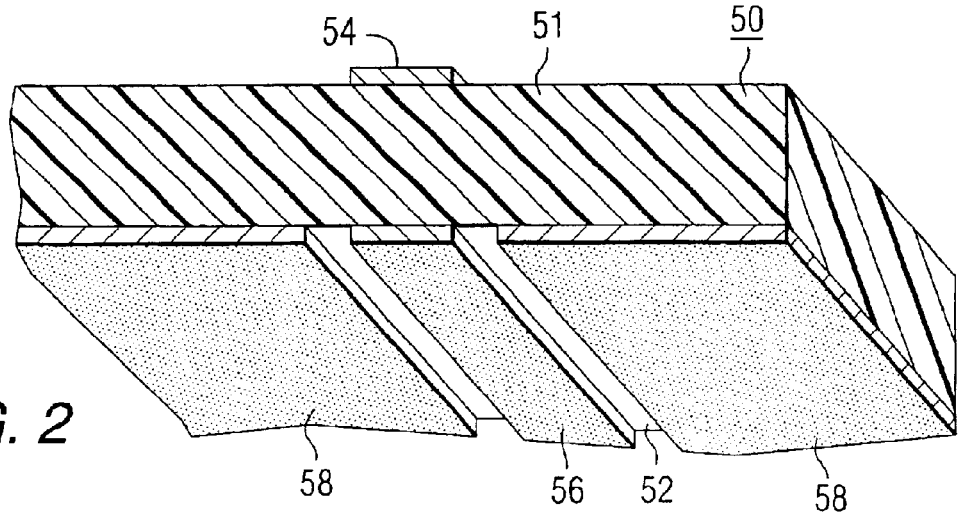
FIG. 2 is a stripline structure serving to illustrate the principle of the present invention.

FIG. 2 shows a portion of a combiner to illustrate salient features of its construction. The combiner includes a dielectric board 50 having opposed first and second surfaces 51 and 52. Deposited on the first surface 51 is a microstrip main line 54 and on the second surface, a microstrip coupled line 56, one of a plurality of such lines. The microstrip coupled line 56 is coplanar with a ground plane 58, while the surface 51, containing the microstrip main line 54 is devoid of any ground plane. Although the first surface 51 is devoid of a ground plane, the microstrip main line 54 utilizes the ground plane on the second surface 52 during microwave transmissions.

Figure 3:
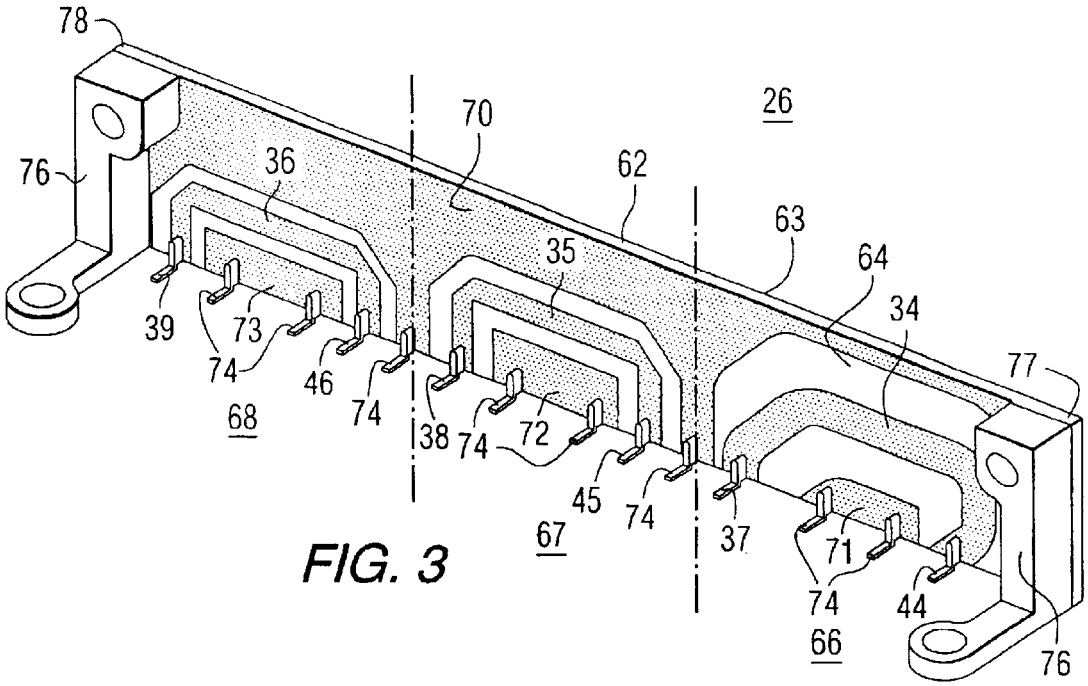
FIG. 3 is a view of a preferred embodiment of the present invention.

A combiner in accordance with the present invention is illustrated in FIG. 3. Combiner 26, corresponding to that described with respect to FIG. 1, includes a dielectric board 62 having first and second opposed surfaces 63 and 64. The dielectric board 62 is of a low dielectric loss material such as a combination of ceramic/polytetrafluoroethylene.

The combiner 26 has three cascades stages 66, 67 and 68 each including a respective one of the microstrip coupled lines 34, 35 and 36, each having an input at one end and a connection at its other end with reference numerals corresponding to that illustrated in FIG. 1. A ground plane 70 is deposited on the second surface 64 of the dielectric board 62 and is disposed above the microstrip lines 34, 35 and 36 and is interposed between stages 66 and 67, and 67 and 68. The ground plane 70 additionally includes ground plane segments 71, 72 and 73 disposed below the microstrip coupled lines. Thus the ground plane 70 straddles the plurality of microstrip coupled lines. Grounding connections 74 are electrically connected to the ground plane 70 for grounding purposes, as will be seen.

In one embodiment of the invention, in order to save space, the combiner may be mounted at right angles to an amplifier board which contains the high power amplifiers 19, 20, 21 and 22, and for this purpose combiner 26 includes L-shaped mounting brackets 76 fastened to respective first and second ends 77 and 78 of the dielectric board 62.

Figure 4:
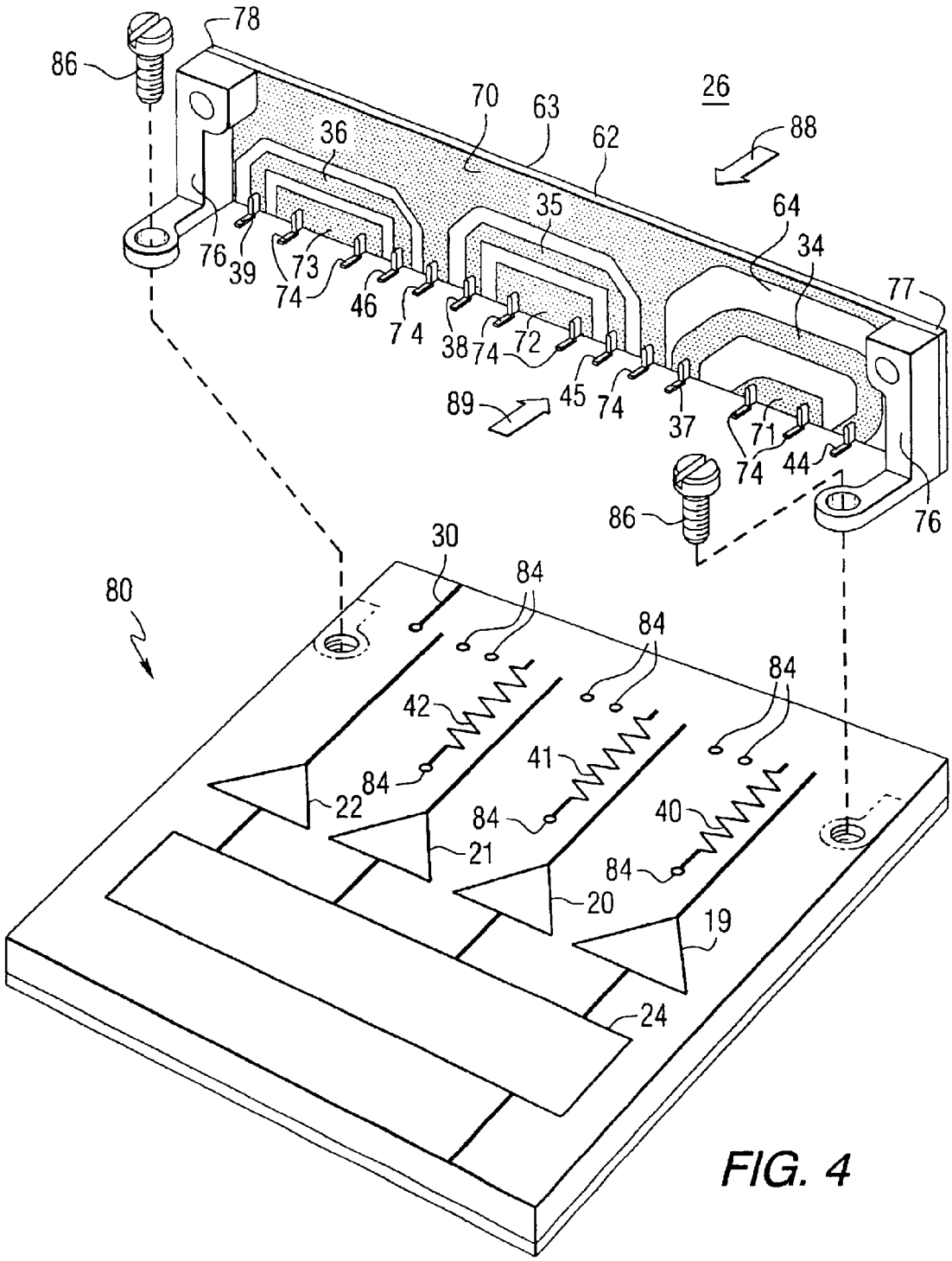
FIG. 4 illustrates the combiner in relation to an amplifier board.

FIG. 4 illustrates the mounting arrangement. High power amplifier board 80 includes 1:4 signal splitter 24, high power amplifiers 19, 20, 21 and 22 as well as isolation resistors 40, 41 and 42, all symbolically illustrated. Board 80 has a ground layer 82 on the undersurface and a plurality of conducting vias 84 for making grounding connections with elements of the combiner 26.

More particularly, after combiner 26 is secured to board 80, by means of fasteners 86, grounding connections 74 are joined with various vias 84 so that ground plane 58 of combiner 26 is electrically connected to ground layer 82. Inputs 37, 38 and 39 are joined with the respective outputs of high power amplifiers 20, 21 and 22 and connections 44, 45 and 46 are joined with respective resistors 40, 41 and 42, the other ends of which are grounded through vias 84.

Figure 5A:
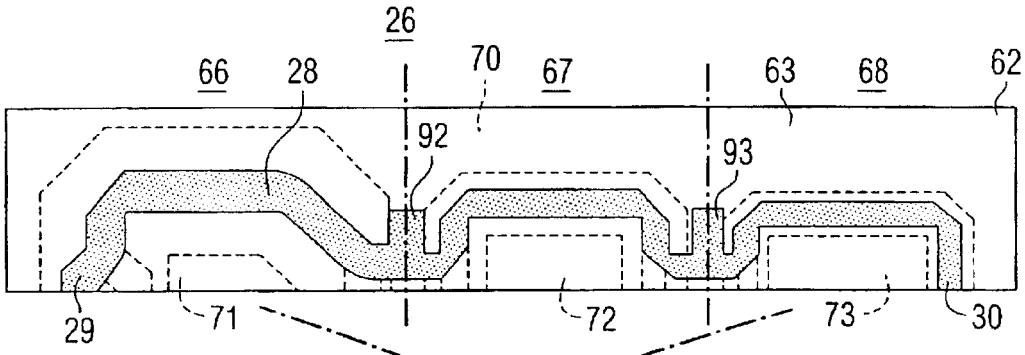
FIGS. 5A and 5B respectively show the stripline pattern on first and second sides of the combiner dielectric board.
Figure 5B:
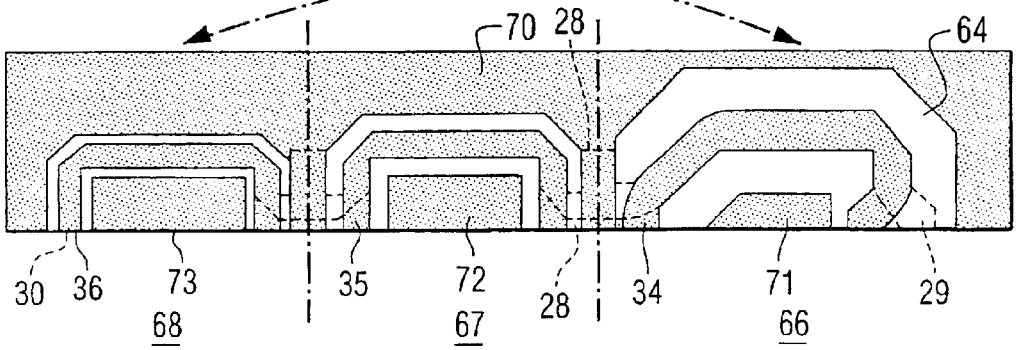

FIG. 5A is a view of the first surface 63 of combiner 26, looking along the direction of arrow 88 in FIG. 4, and FIG. 5B is a view of the second surface 63, looking along the direction of arrow 89 in FIG. 4. In FIG. 5A the metallization pattern of the second surface 64 is shown dotted and in FIG. 5B the metallization pattern of the microstrip main line 28 is shown dotted. It may be seen that the first surface 63 is completely devoid of any ground plane and that the microstrip main line 28 is substantially coextensive with, and overlaps the three microstrip coupled lines 34, 35 and 36.

Further, in FIG. 5B it may be seen that the microstrip coupled lines 34, 35 and 36 progressively decrease in width as a function of its proximity to output 30. This is a well-known technique to achieve correct coupling. For example, microstrip coupled line 34 may be a 3 dB, or ½ power coupler, microstrip coupled line 35 a 4.8 dB. Or ⅓ power coupler and microstrip coupled line 36 a 6 dB, or ¼ power coupler.

During operation, the electromagnetic field in the air, due to the RF signal helps to lower loss, however the wave propagating in the air travels faster than the wave propagating in the dielectric. In order to help match these velocities, and as seen in FIG. 5B, microstrip main line 28 includes matching stubs 92 and 93 between stages 66 and 67 and between stages 67 and 68, respectively.

The foregoing detailed description merely illustrates the principles of the invention. It will thus be appreciated that those skilled in the art will be able to devise various arrangements which, although not explicitly described or shown herein, embody the principles of the invention and are thus within its spirit and scope.

What is claimed is:

1. A microwave signal combiner comprising:

a dielectric board having first and second surfaces;

a microstrip main line disposed on said first surface;

a plurality of cascaded microstrip coupled lines disposed on said second surface, each for receiving a respective microwave signal for coupling to said microstrip main line;

a ground plane on said second surface straddling said microstrip coupled lines;

said first surface being devoid of any ground plane;

said microstrip main line being substantially coextensive with said microstrip coupled lines.

2. A combiner as in claim 1 wherein:

said dielectric board has first and second ends; and which includes first and second mounting brackets respectively secured to said first and second ends for mounting said combiner to another circuit board.

3. A combiner as in claim 2 wherein:

said mounting brackets are L-shaped such that said combiner is mounted at right angles to said another circuit board.

4. A combiner as in claim 1 wherein:

said dielectric board is of a ceramic/polytetrafluoroethylene material.

5. A combiner as in claim 1 wherein:

said respective microwave signals received by said plurality of cascaded microstrip coupled lines are identical.

* * * * *